United States Patent [19]

Stoody, Jr. et al.

[11] 4,258,673

[45] Mar. 31, 1981

[54] CAM LUBRICATION

[75] Inventors: Richard R. Stoody, Jr., New Haven; Ellsworth C. Adams, Birmingham, both of Mich.

[73] Assignee: Chrysler Corporation, Highland Park, Mich.

[21] Appl. No.: 26,394

[22] Filed: Apr. 2, 1979

[51] Int. Cl.[3] ..... F01M 1/06; F01M 9/10

[52] U.S. Cl. ..... 123/90.34; 184/6.5; 184/6.9; 184/11 R; 308/78

[58] Field of Search ..... 123/90.33, 90.34, 196 R; 184/6.5, 6.8, 6.9, 11 R, 11 A; 308/78, 84, 93, 94, 100, 107, 108

[56] References Cited

U.S. PATENT DOCUMENTS

| | | | |
|---|---|---|---|
| 2,869,525 | 1/1959 | Keylwert et al. | 123/90.34 |
| 3,477,417 | 11/1969 | Moulin | 123/90.34 |
| 3,495,685 | 2/1970 | Rinsum | 184/6.5 |
| 3,531,234 | 9/1970 | Ravenel | 123/90.34 |
| 3,958,541 | 5/1976 | Lachnit | 123/90.34 |

FOREIGN PATENT DOCUMENTS

| | | | |
|---|---|---|---|
| 2753752 | 6/1979 | Fed. Rep. of Germany | 123/196 R |

*Primary Examiner*—Charles J. Myhre
*Assistant Examiner*—W. Wolfe
*Attorney, Agent, or Firm*—Newtson & Dundas

[57] ABSTRACT

An improved oiling apparatus for the camshaft lobes of an engine. The bearing portion of the camshaft is supported within a bore between an upper bearing cap member and a lower cylinder head member. Oil passage means extend from a source of pressurized oil through the upper and lower members and intersect or open to the bore at circumferentially spaced locations. The passage openings are interconnected during a portion of the camshaft rotation by a closed-ended groove in the camshaft bearing portion. A small opening or orifice in the cap member communicates with the oil passage and its axis is orientated slightly from normal to the surface of the cap member so as to direct a fine stream of oil onto an active surface of the nearby camshaft lobe. The small hole or orifice opening is drilled through the cap member from a recessed surface established substantially flat and normal to the intended axis of the orifice opening.

7 Claims, 8 Drawing Figures

CAM LUBRICATION

This application relates to an improved lubricating apparatus for cam lobes and particularly to such a system to supply pressurized oil intermittently to a small orifice opening with its axis directed toward the cam lobe.

The invention relates to an improved cam lubricating apparatus in an engine of the type having an overhead cam with active surfaces which directly engage valves or valve actuators. The camshaft is placed in an upper engine location that is far from the usual engine oil passages. Lubrication of cam lobes does not require large volumes of lubricant and therefore it is desirable to limit the volume flowing to the upper portion of the engine so that the larger portions are available for the engine bearings. The camshaft in the subject engine has at least one cylindrical bearing portion adjacent a cam lobe and is supported for rotation within a cylindrical bore formed between a portion of the cylinder head and a bearing cap. Separate bearing means between the camshaft and support members are not utilized. Oil passage means are formed within the cylinder head and the cap member to pass oil from a pressure source to the cam lobes through a passage between the head and cam bearing portions. A small opening in the cap member is communicated with the pressurized oil and its axis is directed toward the adjacent cam lobe. A circumferentially directed groove in the bearing portion of the camshaft extends partially thereabout and is closed-ended so that the pressurized oil communicates with the orifice for only a brief portion of the rotation of the camshaft. Consequently, pressurized oil is supplied to the orifice intermittently so that a short duration of the oil stream is applied to the camshaft lobe during a portion of the camshaft rotation.

Other overhead camshaft lubricating means have included a central bore extending axially the length of the camshaft and cross drilled passages extending to the surfaces of the cam lobes and bearing portions. To achieve desirable wear characteristics of the cam lobes, the camshaft should be cast from a steel material which produces a Class IV carbide level. However, this level of carbides makes the use of cutting tools very difficult and costly. A class II level makes cutting and drilling much easier but the resultant softness results in a rapidly wearing cam.

The subject lubrication means has been developed to eliminate the aforesaid problems. By forming a small discharge passage in the bearing cap, extensive cutting of the camshaft is avoided. Also, a high level of carbide in the camshaft is permitted since this does not adversely affect grinding operations on the camshaft. By utilizing the camshaft support structure for oil distribution to the cam lobes, an advantage is realized in that the surface of the camshaft bearing portions in association with the support structure may be utilized to control oil flow to each discharge passage. A groove or cut is made in the camshaft bearing portion extending a portion of its circumference to provide connection between the oil pressure source and the discharge passage. This connection is made for only a brief duration as the camshaft rotates. The brief duration in which the connection is made provides the desirable intermittent flow of oil so that less oil volume is utilized and therefore the remainder of oil is available for lubricating other portions of the engine.

The subject improved lubricating apparatus for cam lobes is characterized by a brief precisely controlled stream of oil onto the cam lobe to adequately lubricate and to limiting the oil volume necessary. Also, the lubrication apparatus is characterized by ease and economy of manufacture. A lubrication apparatus for cam lobes which does not achieve the aforesaid objectives but represents an early attempt is described in U.S. Pat. No. 3,958,541 to Lachnit which issued on Oct. 29, 1974. This patent discloses the camshaft supported within bearing members which are supported between portions of the engine. The bearings have a circumferentially continuous channel formed therein which is intersected by axially directed channels to pass a continuous flow of oil onto cam lobes. With Lachnit, the difficulties of achieving a desirable precise metering of lubrication to the cam surface are readily apparent. As is well known the tolerances between bearing and shaft may vary considerably. There is also no provision to provide an intermittent application of lubrication and thus a considerable volume of oil for the camshaft is pumped unnecessarily. Another disadvantage in utilizing the bearing members as a means to form an oil outlet to the cam lobes as in Lachnit is the necessity to provide bearings having a sufficiently large diameter to locate the oil passage radial outward of the cam lobe active surface so that the stream of oil may engage these surfaces. This diameter would normally be considerably greater than is economically and functionally warranted for camshaft support.

Since the subject cam lubricating apparatus utilizes a small opening or orifice in the bearing cap to control a stream of oil onto the lobes, a very consistent delivery rate may be provided. Also the provision of passing of the oil through the closed-ended cut or groove in the camshaft bearing portion provides an intermittent oil distribution system which will minimize the quantity of oil necessary to adequately lubricate the cam lobe while simultaneously lubricating the camshaft bearing.

Therefore an object of the present invention is to provide a simple, efficient and easily manufactured lubricating apparatus for the lobes of a camshaft of an engine, the lubricating apparatus characterized by precise control of oil flow onto the cam lobes.

Another object of the present invention is to provide an improved lubricating apparatus for the lobes of a camshaft utilizing a closed-ended groove formed circumferentially in the camshaft bearing portion which is operative as the camshaft rotates with openings of oil passage means to apply oil intermittently to the lobes.

A still further object of the present invention is to provide an improved lubricating apparatus for the lobes of a camshaft in an engine in which a pressurized oil passage terminates with a small diameter opening or orifice with its axis directed toward the active surfaces of the lobes so that a fine spray is applied thereto.

Further objects and advantages of the subject oiling apparatus will be more readily apparent from a reading of the following detailed description, reference being had to the accompanying drawings in which a preferred embodiment is illustrated.

IN THE DRAWINGS

Figure 6:
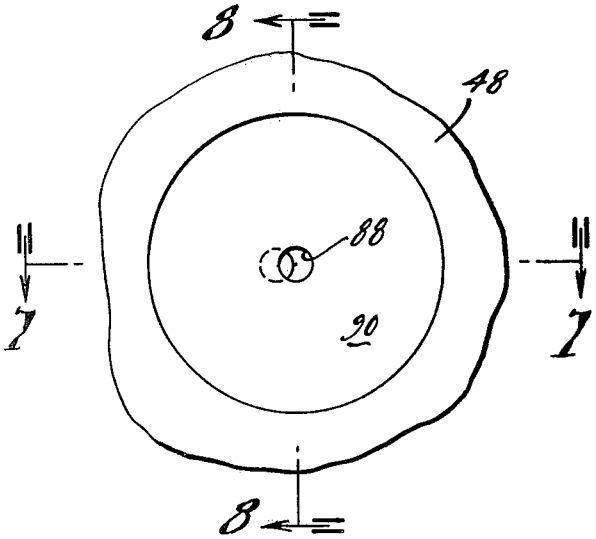
FIG. 6 is an enlarged view of the orifice bore or hole within the encircled portion of FIG. 1.
Figure 8:
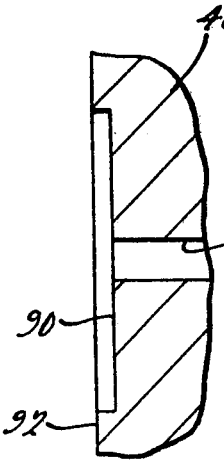
Figure 7:
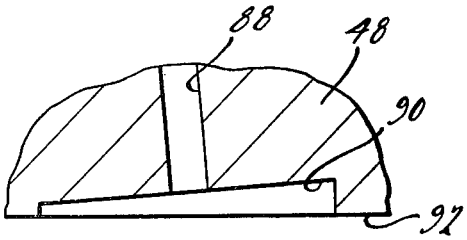

FIGS. 7 and 8 are sectioned views taken along section lines 7—7 and 8—8 respectively in FIG. 6 and looking in the direction of the arrows.

Figure 1:
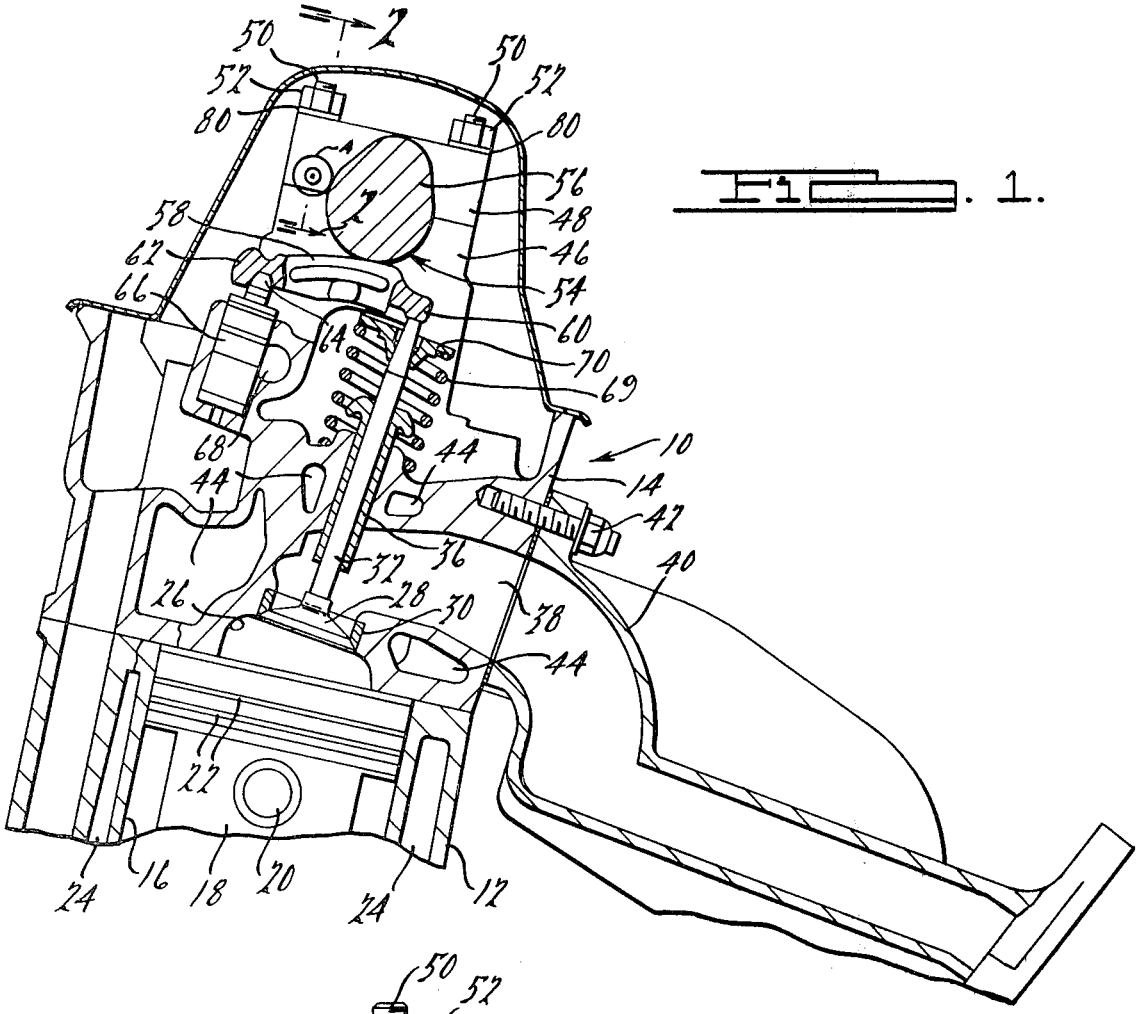
FIG. 1 is a fragmentary and sectioned view of the upper portion of an overhead cam type engine showing portions of the subject cam lubricating apparatus.

In FIG. 1, an engine 10 is illustrated which includes an engine block portion 12 and a cylinder head portion 14. The engine block 12 includes at least one cylindrical bore 16 in which a piston 18 reciprocates in a known manner. In FIG. 1, shown is one end of a wrist pin 20 for connection to a connecting rod (not visible). Piston rings 22 in grooves formed in the piston 18 are also shown. The block 12 includes water passages 24 through which coolant is circulated to cool the block. The cylinder head 14 includes a downwardly directed cup-shaped chamber 26 which forms a recess for movement of valves 28 in a conventional manner. The valves 28 engage seat members 30 supported by the cylinder head 14. Valves 28 include stem portions 32 which extend centrally through valve guides 36 which are supported by the cylinder head 14.

In FIG. 1, a section is taken through an exhaust passage 38 in the cylinder head 14 and an exhaust manifold 40 is shown attached to the cylinder head by fasteners 42. Like the engine block 12, the cylinder head 14 includes coolant passages 44 which are located adjacent the combustion chamber recess 26. A spark plug (not visible in FIG. 1) extends into the recessed chamber 26 and is operative to ignite an explosive mixture therein.

The cylinder head member 14 includes at least one upwardly extending camshaft support portion 46 to which is fastened a bearing cap member 48 by stud 50 and nut 52 fasteners. The members 46,48 encirclingly support a camshaft 54 for rotation. As can be seen in FIG. 1, one of the camshaft lobes 56 engages a mid-portion of an actuator 58. One end 60 of the member 58 engages the upper end of the valve stem 32 and the other end 62 engages an active end 64 of a hydraulic valve adjuster 66. The adjuster operates in a conventional manner to maintain the members 36,54 and 58 in close fitting engagement. The hydraulic adjuster 66 is supplied with pressurized oil through an oil gallery 68.

In operation, the outwardly projecting portion of the cam lobe 56 pivots the member 58 about the upper end of adjuster 66 and moves the valve stem 32 and valve 28 downward to open the exhaust passage 38 to the combustion chamber. In the conventional manner, a spring and spring keeper 69,70 respectively resist the downward opening movement of the valve 28 and restore the valve to the closed position shown in FIG. 1 after the cam has rotated to prevent actuation thereof.

Figure 2:
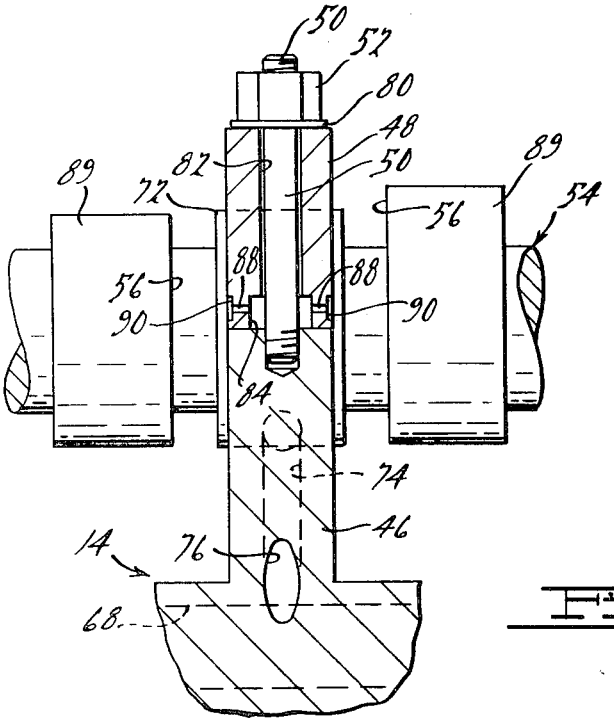
FIG. 2 is an enlarged sectioned view taken along section line 2—2 in FIG. 1 and looking in the direction of the arrows.
Figure 3:
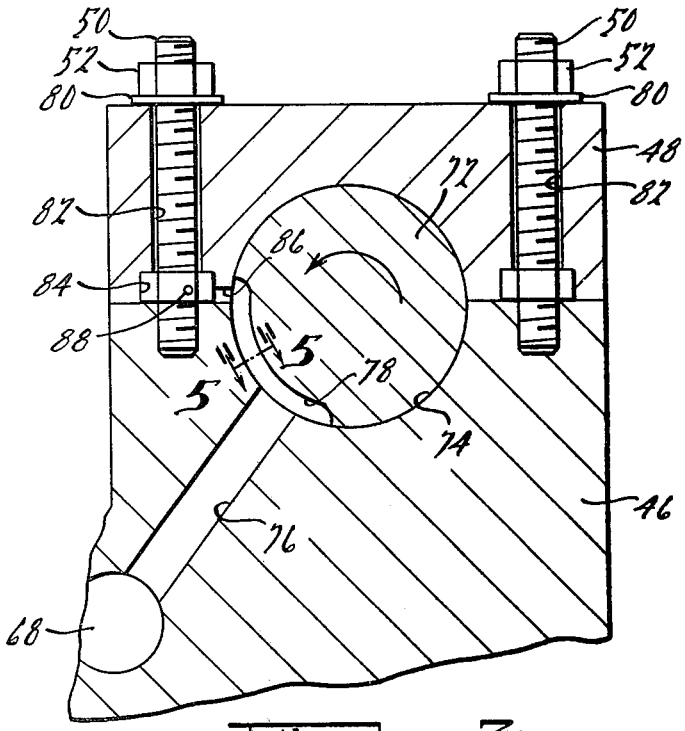
FIG. 3 is an enlarged sectioned view taken along section line 3—3 in FIG. 2 and looking in the direction of the arrows.
Figure 4:
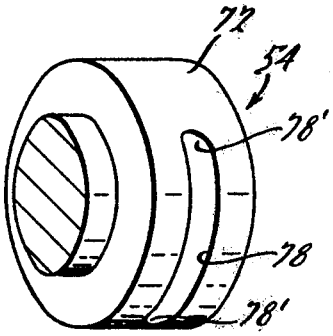
FIG. 4 is a fragmentary sectioned view of the crankshaft's bearing portion.
Figure 5:
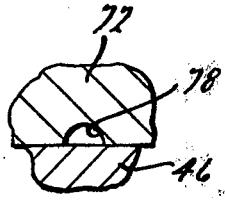
FIG. 5 is an enlarged sectioned view taken along section line 5—5 in FIG. 3 and looking in the direction of the arrows.

In FIGS. 2 and 3, details of the camshaft 54 are shown. Particularly a cylindrical bearing portion 72 of the camshaft 54 is supported between the members 46 and 48. A cylindrical bore 74 is formed between the members 46,48 so that the camshaft bearing portion 72 may extend therethrough and be closely engaged by the surfaces forming the bore. In the particular embodiment illustrated no intermediate bearing members are utilized. With a cylinder head and bearing cap of aluminum and a camshaft of steel, it has been found satisfactory to eliminate conventional bearing members. Note that in FIG. 3 oil gallery 68 is shown which previously was mentioned along with the discussion of the valve adjuster 66. A passage 76 within the member 46 extends from the oil gallery 68 to intersect the bore 74. Thus oil is supplied from the gallery 68 through the passage 76 to the vicinity of the engaging surfaces of the camshaft and the wall forming portions of member 46. A groove 78 of approximately 85° extension is formed within the bearing portion 72 of the camshaft for a purpose which will be more readily apparent hereinafter. The groove 78 has end portions 78' and thus is closed-ended.

The bearing cap member 48 is tightly attached to the member 46 by the stud and nut fasteners 50,52. Washers 80 distribute the load and prevent surface damage to the member 48 as the steel nuts 52 are turned on studs 50. The studs 50 extend downward through bores 82 in member 48 and are threaded at a lower end into the cylinder head 14. At the lower end of the bore 82 and adjacent to the upper surface of portion 46, a recess 84 is formed having a larger diameter than bore 82. This recess acts as an oil distribution chamber which is communicated by a groove 86 (see FIG. 3) with the bore 74. As can be best seen in FIG. 3, the circumferential groove 78 in the camshaft 54 communicates the oil gallery 68 via passage 76, the groove 78 and the groove 86 to the recess 84. The aforementioned structure lubricates the camshaft bearing portion 82 between members 46 and 48.

The aforedescribed apparatus also serves a function of lubricating the adjacent cam lobes 56 as illustrated in FIG. 2, and described hereinafter. For this purpose, an oil passage with a very small diameter opening or orifice 88 is formed in member 48 and within encirclement A of FIG. 1. It extends from an outer surface of member 48 and communicates with the recess 84. The axis of the orifice 88 is oriented at a slight angle from normal so as to direct a fine stream of lubricating oil on the active surface 89 adjacent cams 56. In FIGS. 6, 7 and 8 the axis of orifice 88 is shown extending normal to a recessed surface 90 formed on the member 48. Surface 90 is non-parallel with the surface 92 of portion 48 and is conveniently made by a spot facing or a grinding operation. The surface 90 is substantially flat and formed to facilitate the accurate drilling of the small orifice or opening 88 in member 48. Surface 90 in FIGS. 6–8 is illustrated as formed by spot facing with a small cutting tool. It should be noted that a relatively large grinding wheel (10 inch for example) may be brought in to remove some material from the bearing cap. This provides a substantially flat surface corresponding to the circumferential surface of the grinding wheel.

With reference to the spot facing and grinding operations, it has been found that at low temperatures an oil droplet or bubble may form over the opening. The bubble is rather strongly attached until the oil warms appreciably and may interfere with lubrication of the cam lobe. The formation and attachment of the bubble is closely related to the proximity of sharp edges surrounding the opening 88 which are formed by the recessing operation. It has been found that a substantially flat surface with any edges spaced at least 0.20 inch from the opening is sufficient to prevent formation and atttachment of the oil bubble at temperatures down to about −20° F.

By way of example, in an embodiment a 0.32" diameter drilled hole has been found to provide adequate lubrication of cam lobes. An alternative arrangement utilized rectangular crossed slots forming an opening with a dimension of 0.32" by 0.032". Formation of recesses and a surface normal to the desired axial extent of the opening is necessary when a hole of such a small diameter is drilled in the bearing cap member.

The angular orientation of the passage 88 with respect to the surface 92 as shown in FIG. 7 is about 20° in a preferred embodiment. Depending on the radial distance outward from surfaces 89 of the camshaft, the angle may vary but should always be directed inward at an oblique angle with respect to the axis of the camshaft.

Of interest is the orientation of the axis of the passage 88 in a horizontal plane which is parallel to another horizontal plane coincident with the camshaft axis. The planes may be vertically spaced. Thus the passage 88 may be directed obliquely to the camshaft axis when a view thereof is taken from above but the direction is parallel to the camshaft axis when a view is taken from the side as in FIG. 2. This is very desirable in that the stream of pressurized oil will first engage the active surface of the nearest cam lobe but some oil will deflect therefrom and subsequently engage the active surface of the next adjacent cam lobe. To most advantageously utilize this characteristic, the grooves or cuts 78 taken in the bearing portions 72 are alternately spaced 180° from one another. Thus in a five bearing camshaft, the first, third and fifth bearing portions have cuts 78 angularly aligned while in the second and fourth bearing portions the cuts 78 are 180° spaced therefrom. Resultantly, each lobe gets a direct hit of oil approximately every rotation and an indirect or "skip" hit therebetween.

Although essentially only one embodiment of the subject invention has been illustrated and described in great detail, modifications would readily come to the mind of one skilled in the art which would still fall within the scope of the following claims which solely define the invention.

We claim:

1. In an engine having a cylinder head and a pressurized oil gallery extending therein, a lubricating apparatus for an active surface of a camshaft lobe comprising a bearing cap member attached to the cylinder head and defining therewith a bore through which a bearing portion of the camshaft extends for rotative support, the camshaft bearing portion being located adjacent a cam lobe which rotates with the camshaft adjacent a side surface of the bearing cap member, first and second passage means in the cylinder head and bearing cap member respectively, the first passage means communicating directly with the oil gallery, a small dimension opening with respect to the second passage means opening through the side surface of the cap member and being communicated with the second passage, the first and second passage means intersecting the bore between the cylinder head and bearing cap member at circumferentially spaced locations, means rotative with the camshaft portion for interconnecting first and second passage means during only a portion of each rotation of the camshaft, the small dimension opening extending through the side surface of the cap member being located radially outward from the active surface of the lobe and with an axis directed radially inward at the active surface whereby the stream of oil is intermittently directed against the cam lobe.

2. The lubricating apparatus of claim 1 in which the small dimensioned opening is a circular bore with an axis oblique to a line perpendicular to the side surface and means forming a secondary surface with respect to the planar extent of the side surface which surface is normal to the axis of the circular bore.

3. The lubricating apparatus of claim 2 in which the small dimensioned opening is a substantially circular bore having a diameter of about 0.032".

4. An engine having a camshaft with at least one lobe and an improved lubricating means therefor comprising; at least one bearing portion of the camshaft located adjacent the cam lobe; mating members forming a rotative support seat therebetween for the bearing portion; a source of pressurized lubricating oil and a first passage means extending therefrom through one of the mating members and to a passage opening at a first circumferential location of the rotative support seat; second passage means extending through the other member from a passage opening at a second circumferential location of the rotative support seat; a small opening in the other mating member communicated with the second passage means thus forming an orifice for producing a fine stream of oil onto an adjacent cam lobe; means in the camshaft including a groove extending in a circumferential direction in the bearing portion to communicate the first and second passage means, the groove having closed ends so that the aforesaid communication occurs only during a portion of each rotation of the camshaft whereby pressurized oil is emitted intermittently from the orifice; the small diameter passage extending axially through the other mating member at an angle slightly oriented from a normal to the surface thereof and a recessed surface formed in the other mating member with a planar extent normal to the axis of the small diameter passage thereby facilitating formation of the passage and providing a circular opening through the surface of the other mating member.

5. The engine and improved lubricating means of claim 4 in which the small diameter passage has a diameter of about 0.032".

6. An engine having a rotating crankshaft and a camshaft with at least one lobe thereon and an improved lubricating means comprising: at least one bearing portion located adjacent the cam lobe; mating members forming a rotative support seat therebetween for the bearing portion; a source of pressurized lubricating oil communicated with a first passage means extending through one of the mating members and to an opening at a first circumferential location of the rotative support seat for transmitting pressurized oil thereto; second passage means extending through the other of the mating members from an opening at a second circumferential location of the rotative support seat; small diameter passage means in the other mating member communicated with the second passage means thus forming an orifice through the outer surface of the other mating member for producing a fine stream of oil onto an ajacent cam lobe; passage means in the camshaft bearing portion for communicating the first and second circumferentially oriented openings during a portion of each camshaft rotation, the camshaft passage means being configured to communicate the pressurized oil source with the small diameter passage during about 30° of the engine crankshaft rotation whereby pressurized oil is emitted intermittently from the orifice.

7. The engine and improved lubricating means of claim 6 in which the passage openings in the rotative support seat for the camshaft bearing portion are spaced about 60° while the opposite end portions of the camshaft groove are spaced about 85°.

* * * * *